US006089202A

United States Patent [19]

Nomura et al.

[11] Patent Number: 6,089,202

[45] Date of Patent: Jul. 18, 2000

[54] AIR-SUPPLY MODULE FOR INTERNAL COMBUSTION ENGINE

[75] Inventors: Yurio Nomura, Nagoya; Akihide Yamaguchi, Kariya; Kouichi Hattori, Nishio, all of Japan

[73] Assignee: Denso Corporation, Japan

[21] Appl. No.: 09/129,173

[22] Filed: Aug. 4, 1998

[30] Foreign Application Priority Data

| | | | |
|---|---|---|---|
| Aug. 21, 1997 | [JP] | Japan | 9-225183 |
| Aug. 27, 1997 | [JP] | Japan | 9-231247 |
| Aug. 28, 1997 | [JP] | Japan | 9-232282 |
| Aug. 28, 1997 | [JP] | Japan | 9-232283 |
| Sep. 1, 1997 | [JP] | Japan | 9-236072 |

[51] Int. Cl.[7] ..... F02M 31/20

[52] U.S. Cl. ..... 123/184.42

[58] Field of Search ..... 123/184.42, 198 E

[56] References Cited

U.S. PATENT DOCUMENTS

| | | | |
|---|---|---|---|
| 4,409,934 | 10/1983 | Kaindl | 123/184.42 |
| 5,494,497 | 2/1996 | Lee | 123/198 E |
| 5,575,247 | 11/1996 | Nakayama et al. | 123/184.42 |
| 5,664,533 | 9/1997 | Nakayama et al. | 123/184.42 |
| 5,826,553 | 10/1998 | Nakayama et al. . | |
| 6,024,066 | 2/2000 | Nakayama et al. . | |

FOREIGN PATENT DOCUMENTS

| | | |
|---|---|---|
| 0523027 A2 | 1/1993 | European Pat. Off. . |
| 6-081735 | 3/1994 | Japan . |
| 8-093580 | 4/1996 | Japan . |

*Primary Examiner*—Noah P. Kamen
*Attorney, Agent, or Firm*—Nixon & Vanderhye PC

[57] ABSTRACT

An air-supply module including an air cleaner case, a throttle body, a surge tank, manifold pipes and other components is integrated into one single unit. The module is mounted as a whole on an internal combustion engine by simply connecting a flange formed at an eigne side end of the manifold pipes to intake ports of the engine. Bolts sticking out of the intake ports are inserted into mounting holes formed on the flange, and nuts are screwed onto the bolts by a nut runner. The mounting holes on the flange are located between the manifold pipes so that the nut runner can reach the nuts directly from the outside of the module without disassembling any components already assembled into the module. Other components including the air cleaner case are disposed in the module to secure a tool space and not to interfere with the mounting operation.

28 Claims, 18 Drawing Sheets

AIR-SUPPLY MODULE FOR INTERNAL COMBUSTION ENGINE

CROSS-REFERENCE TO RELATED APPLICATIONS

This application is based upon and claims benefit of priority of Japanese Patent Applications No. Hei-9-225183 filed on Aug. 21, 1997, No. Hei-9-231247 filed on Aug. 27, 1997, No. Hei-9-232282 filed on Aug. 28, 1997, No. Hei-9-232283 filed on Aug. 28, 1997 and No. Hei-9-236072 filed on Sep. 1, 1997, the contents of which are incorporated herein by reference.

BACKGROUND OF THE INVENTION

1. Field of the Invention

The present invention relates to an air-supply module for an internal combustion engine, in which an air cleaner, a throttle body, a surge tank, intake manifold pipes and other components are integrated into a single module that can be mounted on the engine as a single unit.

2. Description of Related Art

Air-supply modules of this kind are disclosed in, for example, JP-A-8-93580, JP-A-8-334070, JP-A-8-210200, and JP-A-6-81735. In the conventional modules disclosed in those publications, a space for inserting tools for mounting the module on the internal combustion engine is not provided. Accordingly, some components such as an air cleaner case and a throttle body have to be once disassembled from the module to provide a space for inserting tools that are necessary for mounting the module on the engine, and after the module is mounted on the engine the once removed components are separately mounted on the module again. Although an advantage of integrating all components into a single module is to simplify the mounting process, the module cannot be mounted on the engine in a single step, but it has to be mounted in several steps. This hampers mounting efficiency.

SUMMARY OF THE INVENTION

The present invention has been made in view of the above-mentioned problem, and an object of the present invention is to provide an air supply module into which all the components are integrated as a single unit that can be assembled on the engine in a single step without disassembling any components from the module. For this purpose a space for inserting a tool directly from the outside of the module is provided.

An air-intake passage including an air cleaner case and a throttle body, a surge tank, and manifold pipes, are all assembled in a single unit constituting an air-supply module. The air-supply module is mounted on the engine by connecting a flange formed at an engine side of the manifold pipes to the engine. The air cleaner case is divided by an air cleaner element into two spaces, a dust side space to which outside air is introduced and a clean side space to which air filtered by the air cleaner element is introduced. The throttle body contains a throttle valve that controls amount of air to be supplied to the engine. The air flows into the surge tank from the air-intake passage, and air pulsation is alleviated therein. Then, the air is supplied to the engine through the manifold pipes which are formed for each cylinder of the engine. The flange connecting all manifold pipes at their engine side is formed as an integral part of the manifold pipes. The flange is mechanically connected to intake ports of the engine by, for example, bolts fixed to the intake ports, mounting holes formed on the flange, and nuts screwed on the bolts. A tool for mounting the air-supply module on the engine has to be allowed to reach the flange portion directly from the outside of the module in order to perform the mounting operation without disassembling some parts or components from the module. For this purpose a tool space or spaces are provide in the module.

To secure a sufficient mechanical strength, the air-intake passage and the manifold pipes are connected together by connecting members which in turn are connected to the mounting flange. Preferably, the connecting members are formed along each manifold pipe to further enhance the mechanical strength of the module as a single unit.

Injectors that supply fuel in a controlled manner may be installed on the mounting flange so that each injector corresponds to each manifold pipe. If the injectors are included in the module, the air-supply module functions as a fuel supply module as well.

The surge tank may be positioned at various places, for example, it may be placed at the bottom of the module and may be connected to the air cleaner case through a connecting duct. In this structure, the connecting pipe is disposed in parallel to the manifold pipes at an overlapped position with one of the manifold pipes to secure a sufficient space for inserting the mounting tool. The longitudinal direction of the surge tank may be placed in parallel to the direction of the engine cylinder alignment, and the connecting pipe is connected to the center of the surge tank.

Preferably, the air cleaner element is placed in parallel with the engine cylinder alignment direction in the air cleaner case, and is disposed so that it can be sildably inserted and removed from the air cleaner case in the direction perpendicular to its thickness. By placing the air cleaner element in this manner, an opening slot for inserting and removing the element can be made small in size. Preferably, a shaft for driving the throttle valve is disposed in parallel to the engine cylinder alignment to secure a sufficient space for a drive lever connected to one end of the shaft and a potentiometer disposed at the other end of the shaft. The potentiometer is used for detecting an opening degree of the throttle valve.

Other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 3:
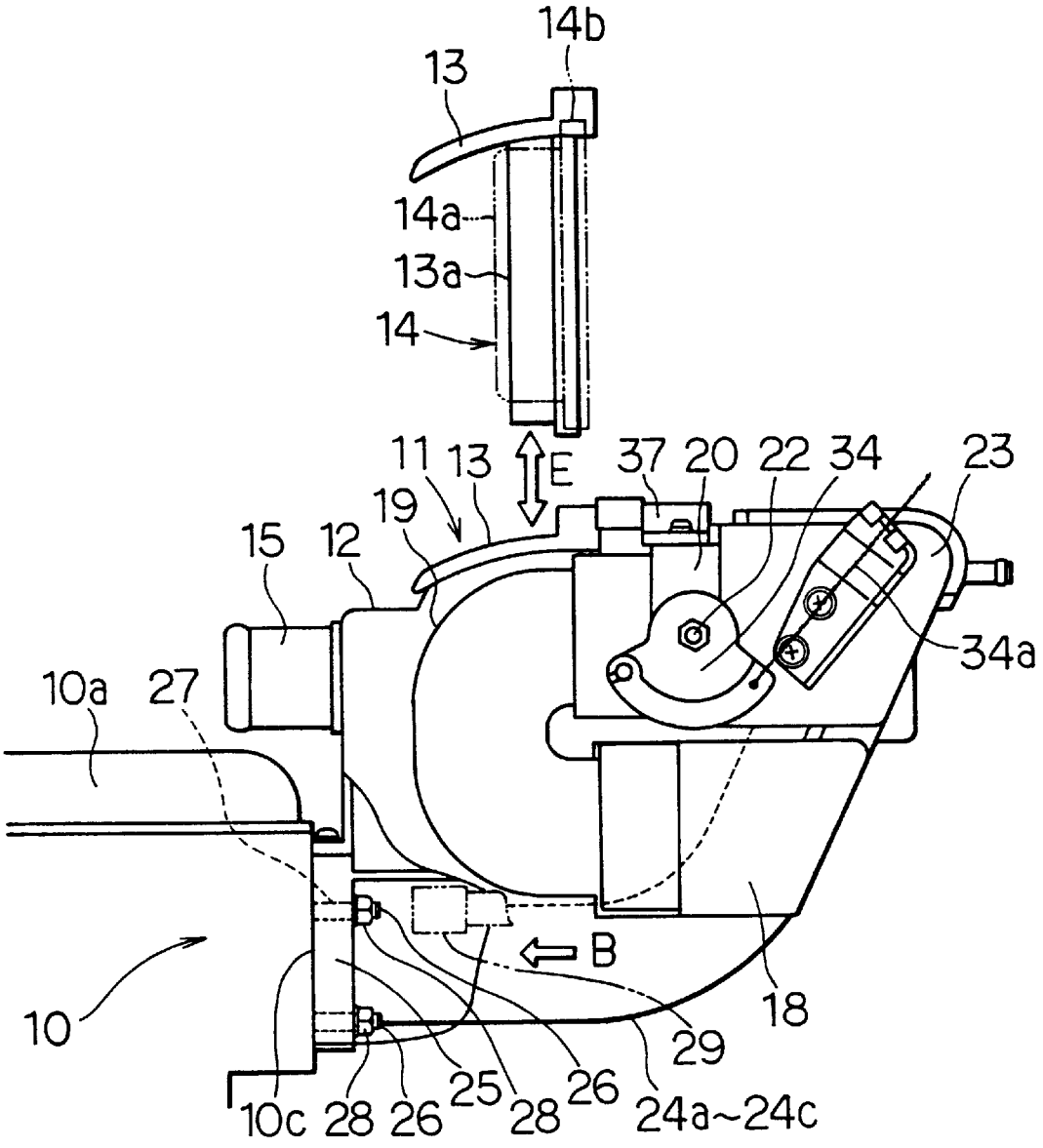
FIG. 3 is a right side view of the air-supply module shown in FIG. 1.
Figure 4:
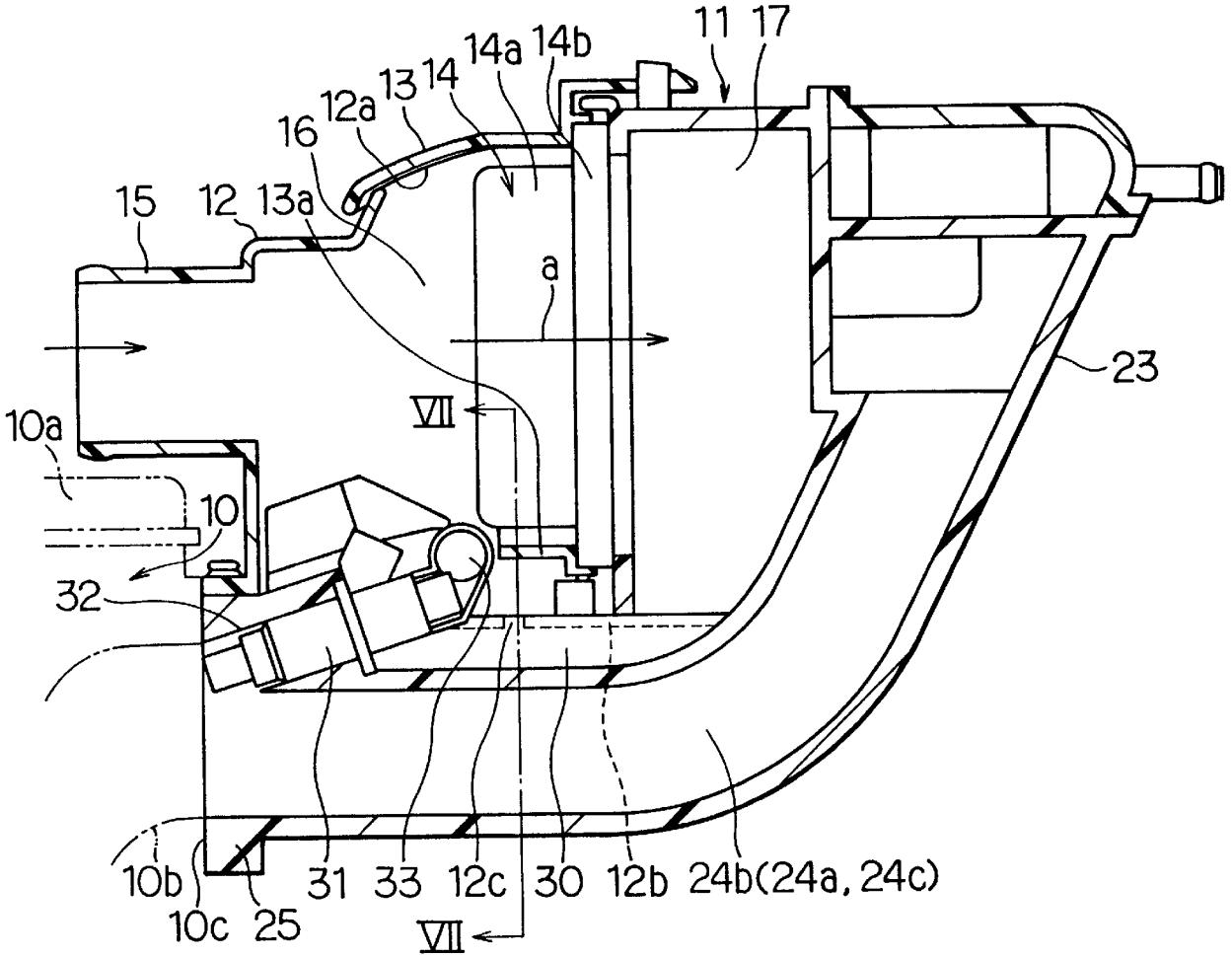
FIG. 4 is a cross-sectional view of the air-supply module shown in FIG. 1, taken along a line IV—IV in FIG. 1.

A first embodiment of the present invention will be described, referring to FIGS. 1 to 8. Since FIGS. 1 to 7 show the same air-supply module as the first embodiment viewed from various directions or in cross-sections, they will be referred to in the following description at the same time. An air-supply module 11 is designed to be used for an internal combustion engine 10 having three cylinders. The three cylinders of the engine 10 are aligned in front of the air-supply module 11 in the left-to-right direction in FIG. 2. The engine 10 includes a cylinder head 10*a* and an air-intake port 10*b* (FIGS. 3, 4).

Figure 8:
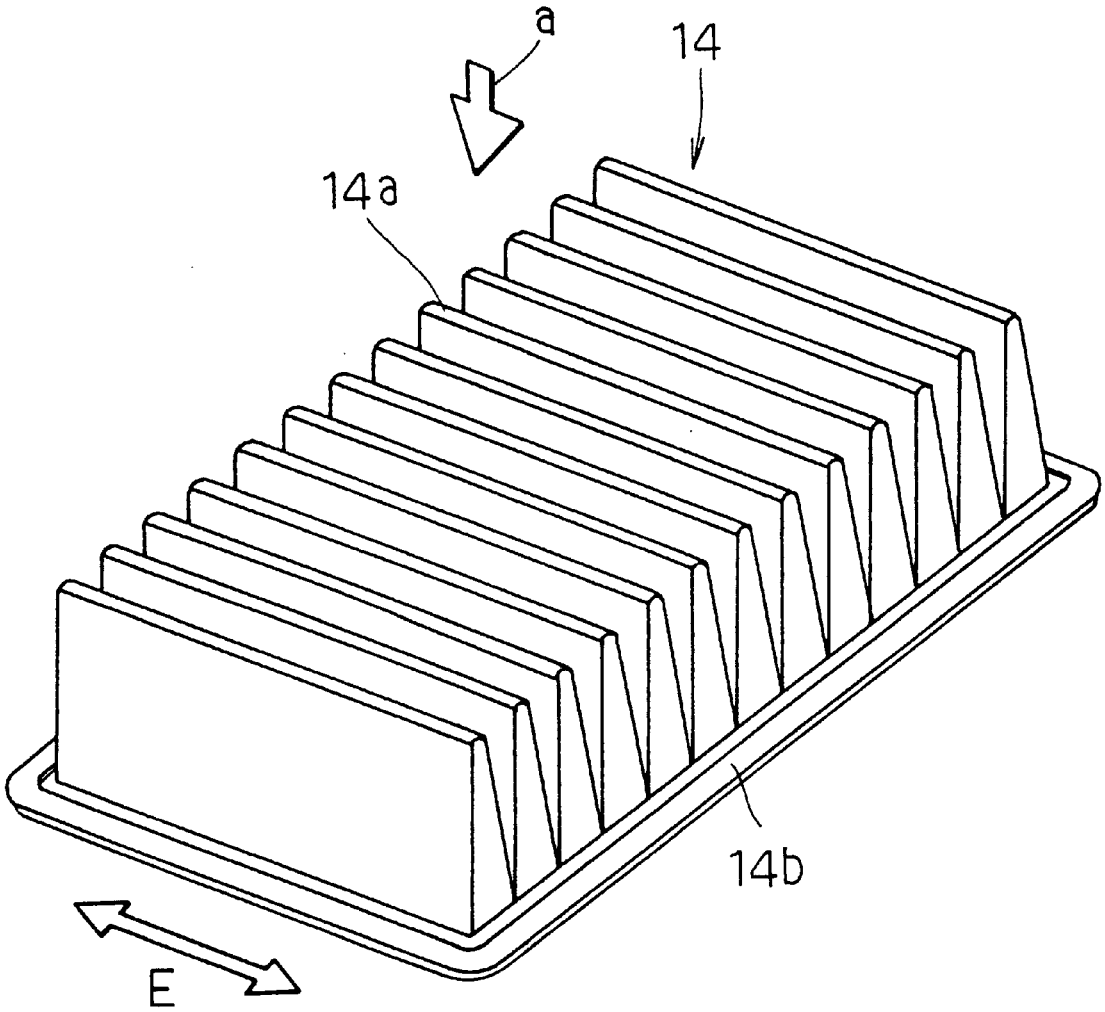
FIG. 8 is a perspective view showing an air cleaner element used in the air-supply module shown in FIG. 1.

The air-supply module 11 as an integral unit includes: an air cleaner case 12 disposed on an upper portion close to the engine 10, a surge tank 23 connected to the down stream of the air cleaner case 12, three manifold pipes 24*a* to 24*c*, and other components. All of those components are integrally formed into one unit and mounted on the engine 10 by connecting a flange 25 formed at the ends of the manifold pipes to intake ports 10*b* of the engine 10. On the top portion of the air cleaner case 12, an opening 12*a* is formed. A removable cap 13 covers the opening 12*a*. A rectangular-shaped supporting frame 13*a* extending downward are integrally formed with the cap 13 (FIG. 3). An air cleaner element 14 is supported inside the supporting frame 13*a* and held in the air cleaner case 12 at its middle portion. A perspective view of the air cleaner element 14 is shown in FIG. 8. It has a wave-shaped cleaning surface 14*a* and an outer edge 14*b* surrounding the outer sides. Both of the cleaning surface 14*a* and the outer edge 14*b* are made of the same filtering material such as synthetic non-woven cloth or filter paper. Air cleaner case 12 and the cap 13 are made of resin such as nylon that has some resiliency and sufficient mechanical strength. Other resin components described later are also made of the same kind of resin.

Figure 5:
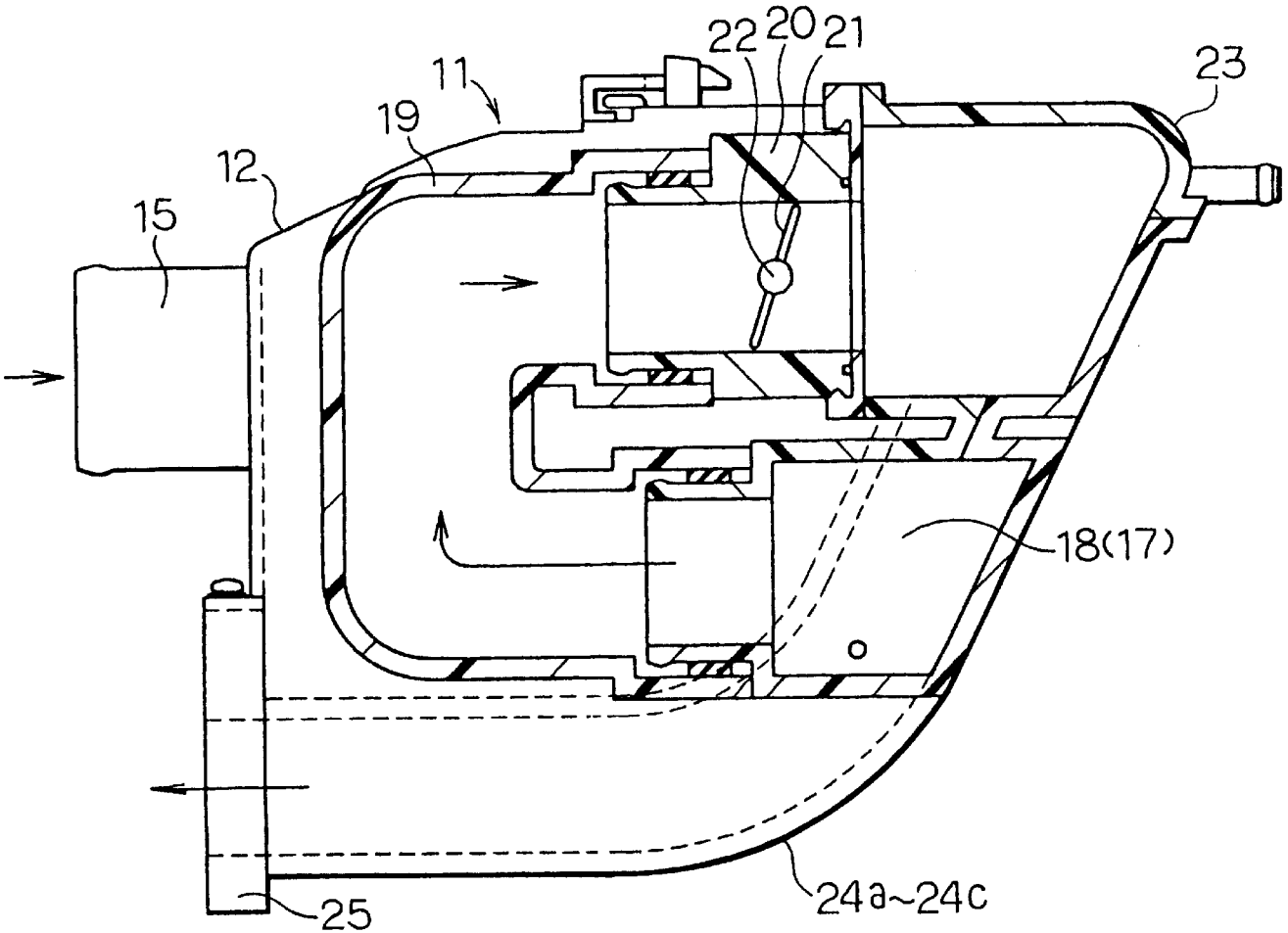
FIG. 5 is a cross-sectional view of the air-supply module shown in FIG. 1, taken along a line V—V in FIG. 1.

An air intake port 15 is disposed at an engine side end of the air cleaner case 12, and outside air is introduced into the air cleaner case 12 from the air intake port 15. The air introduced into the air cleaner case 12 flows in a direction "a" (shown in FIG. 4) through the air cleaner element 14, and thereby dusts contained in the air are filtered. Therefore, the left side of the air cleaner element 14 is a dust side space 16, and the right side is a clean side space 17. A drain hole 12*c* for draining water is formed on a bottom wall 12*b* of the air cleaner case 12 in the dust side space 16 (FIG. 4). The clean side space 17 communicates with a communication chamber 18 formed at a remote end from the engine 10 (FIGS. 2, 5). A bottom end of a connecting duct 19 made of resin is air-tightly connected to the communication chamber 18. An upper end of the connecting duct 19 is connected to an upstream end of a throttle body 20 that is also made of resin (FIG. 5). A throttle valve 21 is rotatably supported in the throttle body 20 by a shaft 22. The throttle valve is operated by a known mechanism connected to an acceleration pedal of an automobile and controls amount of air taken into the engine 10.

A surge tank 23 made of resin is disposed at a downstream end of the throttle body 20. The surge tank 23 enlarges a space at the downstream of the throttle body 20 for alleviating and absorbing pulsation of the intake air (FIG. 5). The surge tank 23 is located at a remote end from the engine 10 and extended in parallel to a direction of the engine cylinder alignment with a full width "W" shown in FIG. 1. The manifold pipes 24*a*, 24*b*, 24*c* made of resin are connected to the surge tank 23. Though FIG. 4 shows only one manifold pipe 24*b* that is located in the middle, other manifold pipes 24*a*, 24*c* have the same shape as the manifold pipe 24*b*. The manifold pipes are curved and extended along the bottom wall 12*b* of the air cleaner case 12 toward the engine 10 as shown in FIG. 4.

A flange 25 is formed integrally with the manifold pipes at the engine side end thereof. The flange 25 has a flat surface which abuts with a mounting surface 10*c* of the intake port 10*b*. Bolts 26 are fixed to the intake port 10*b* and stick out therefrom (FIG. 3). Mounting holes 27 (six holes in this embodiment) are formed on the flange 25 (FIG. 2) through which the bolts 26 are inserted, and the flange 25 is fixedly connected to the mounting surface 10*c* (FIG. 3) with nuts 28, thereby mounting a whole air-supply module 11 on the engine 10. The nuts 28 are screwed on the bolts 26 by a nut runner 29 (FIG. 3).

Figure 6:
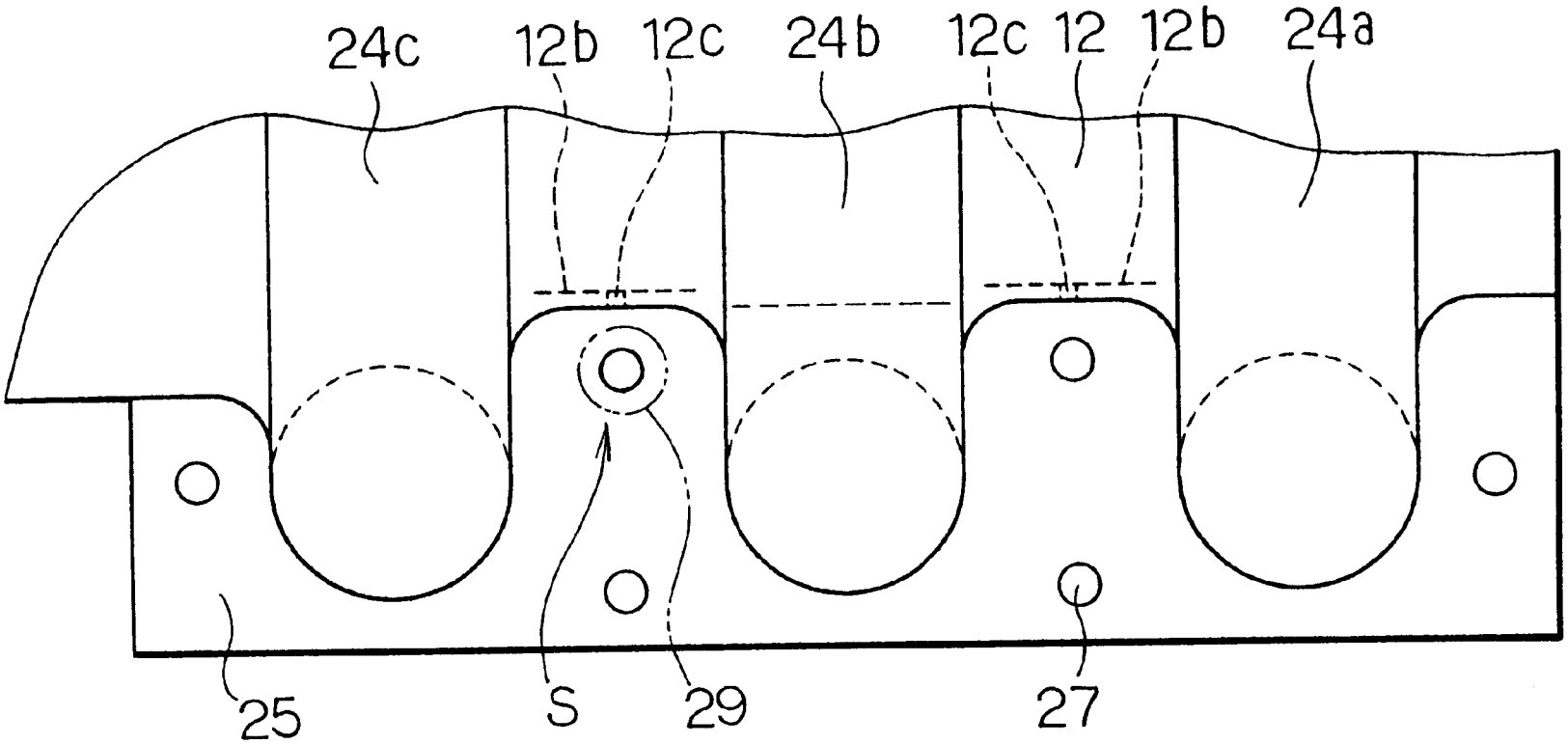
FIG. 6 is a fragmentary view showing the air-supply module shown in FIG. 1, viewed from a direction B in FIG. 3.
Figure 7:
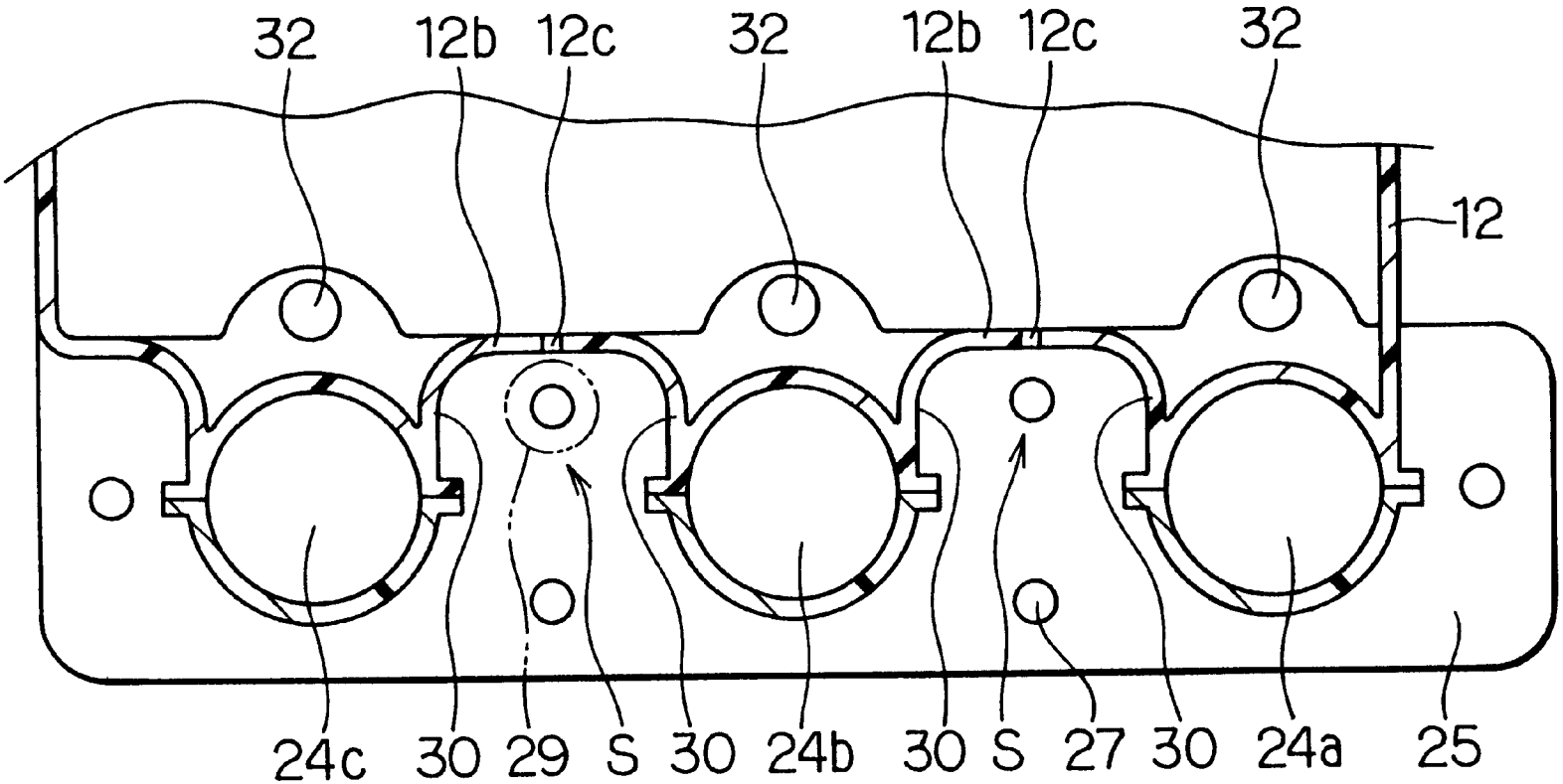
FIG. 7 is a fragmentary cross-sectional view showing the air-supply module shown in FIG. 1, taken along a line VII—VII in FIG. 4.

In order to secure a space for inserting the nut runner 29 for mounting the air-supply module 11 on the engine 10, the structure as shown in FIGS. 6, 7 is employed. FIG. 6 is a fragmentary view viewed from a direction "B" shown in FIG. 3, and FIG. 7 is a fragmentary cross-sectional view taken along a line VII—VII shown in FIG. 4. Two mounting holes 27 are formed in the respective spaces between the manifold pipes, and one each mounting hole 27 is formed on both ends of the flange 25. The number of the mounting holes 27 is six altogether. Tool spaces "S" are secured in the area between the manifold pipes 24*a*, 24*b*, 24*c* and the bottom wall 12*b* of the air cleaner case 12. The tool space "S" is secured in the direction perpendicular to the flange 25, so that the nut runner 29 can reach the mounting hole 27 from the outside of the assembled air-supply module 11. The bottom wall 12*b* at the space between the manifold pipes 24*a*, 24*b*, 24*c* is located above the mounting hole 27, leaving a space sufficient to secure the tool space "S." The bottom wall 12*b* is connected to each manifold pipe via a connecting wall 30 having a smooth circular curve as shown in FIG. 7. An upper portion of the manifold pipe serves as the bottom wall of the air cleaner case 12, as well. Thus, the air cleaner case 12 and the manifold pipes 24*a*, 24*b*, 24*c* are mechanically connected to each other. The connecting wall 30 is formed with respect to each manifold pipe and is also connected to the flange 25. Also, the connecting wall 30 extends along the manifold pipe as shown in FIG. 4.

A fuel injector 31 that injects fuel into the engine 10 is disposed on the flange 25, corresponding to each manifold pipe as shown in FIGS. 2 and 4. Three injector holes 32 are formed through the flange 25, and the injectors 31 are inserted into the injector holes 32 and fixed therein. As shown in FIG. 4, the injector 31 is located in the dust side space 16, and a fuel delivery pipe 33 is disposed in parallel to the cylinder alignment direction. The fuel delivery pipe 33 is connected to each injector 31 to supply fuel thereto. The fuel injector 31 is electronically controlled by a known device. The delivery pipe 33 sticks out from the air-supply module 11 (FIGS. 1, 2) to which fuel is supplied from a fuel pump through a fuel supply pipe (not shown in the drawings).

Figure 1:
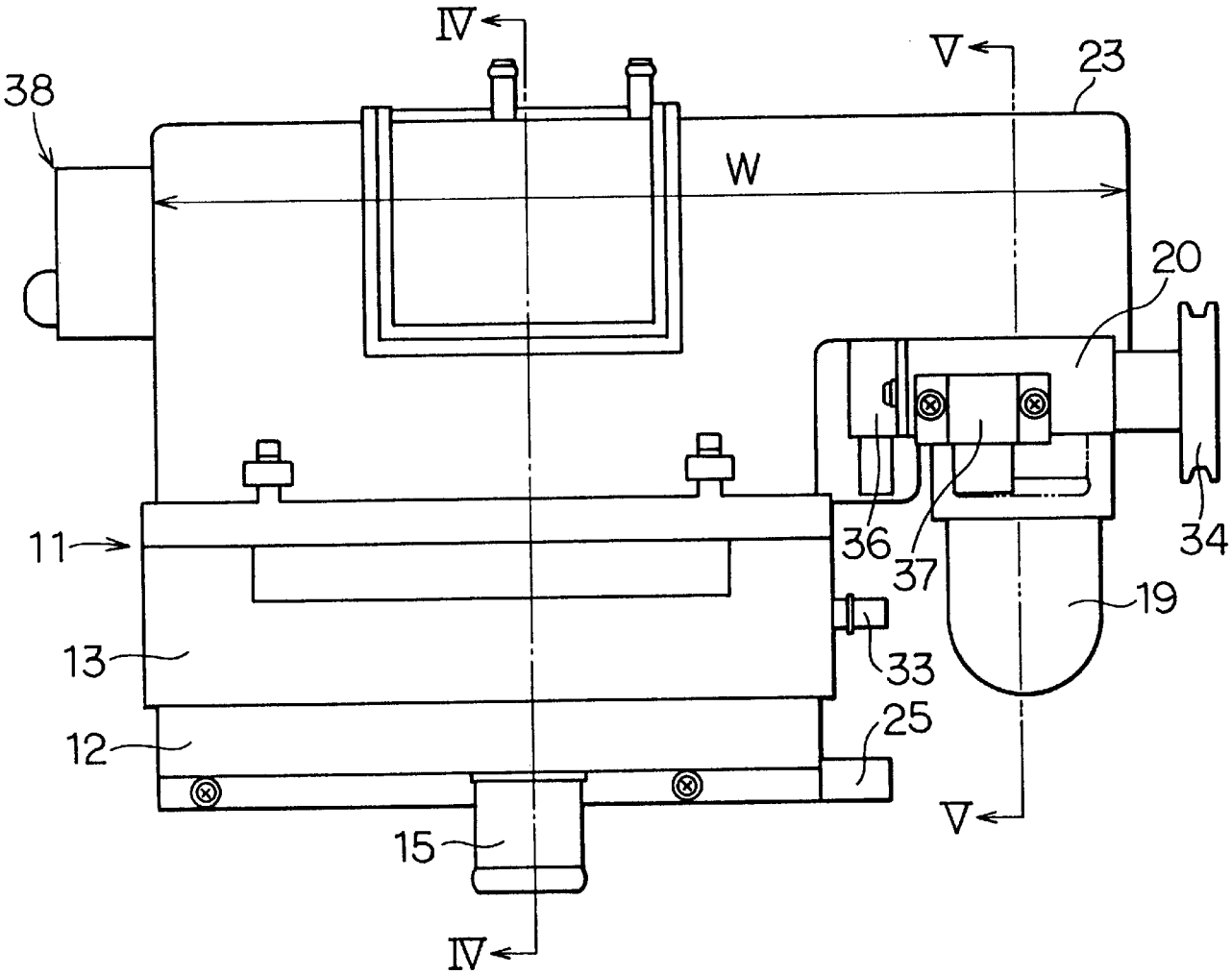
FIG. 1 is a top view showing an air-supply module as a first embodiment of the present invention.
Figure 2:
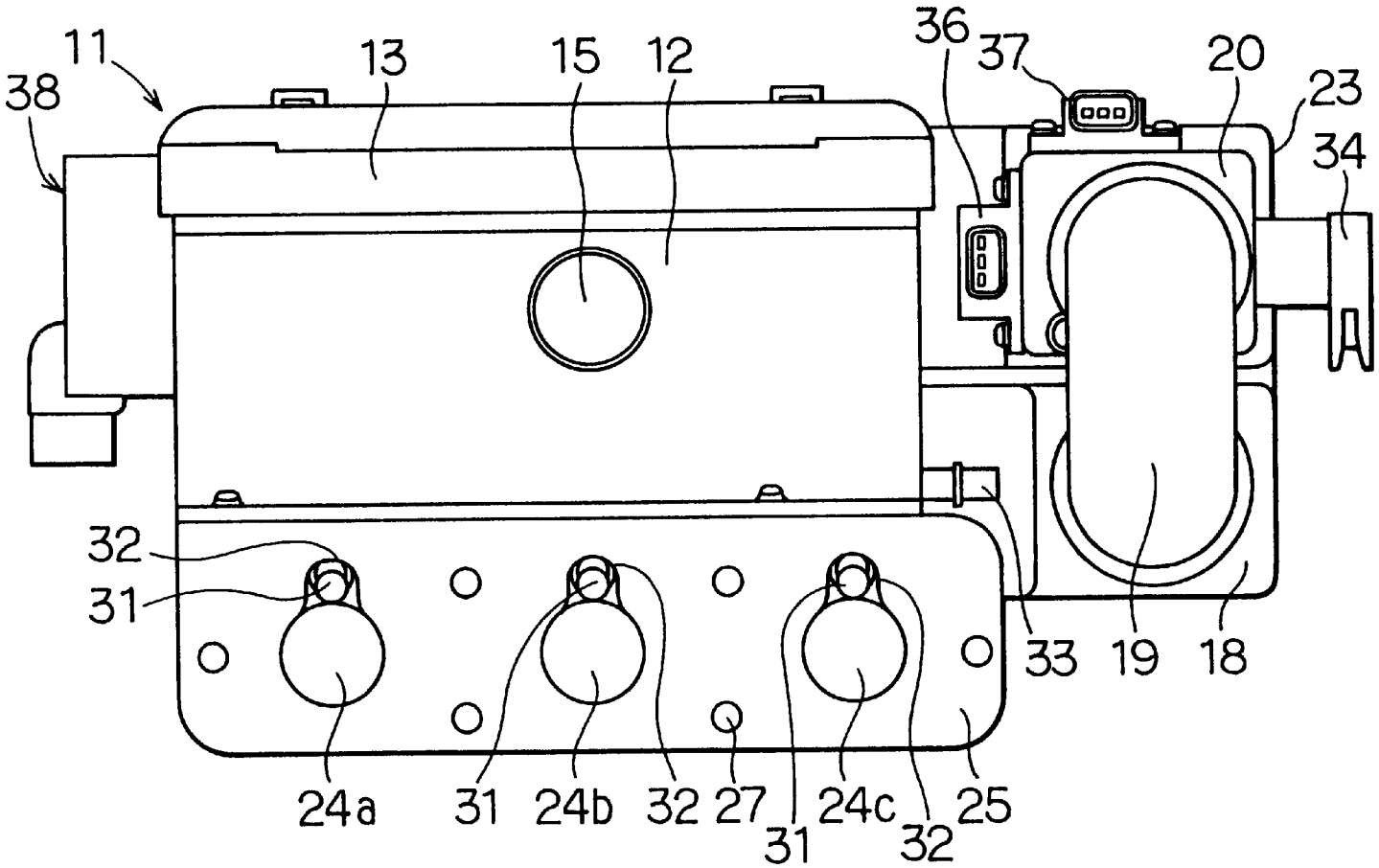
FIG. 2 is a front view of the air-supply module shown in FIG. 1.

As shown in FIGS. 1 and 2, the air cleaner case 12 and the surge tank 23 are aligned in parallel to the engine cylinder alignment direction, and the connecting duct 19 and the throttle body 20 are located at one longitudinal end of the air-supply module 11 (at the right side of FIGS. 1, 2). A drive lever 34 is connected to one end of the shaft 22 of the throttle body 20, and the drive lever 34 is driven by an acceleration pedal via a cable 34*a* connected to the drive lever 34 (FIG. 3). The other end of the shaft 22 is connected to a rotary potentiometer 36 that detects a degree of the throttle valve opening. An air-flow meter 37 that detects amount of air taken into the engine 10 is disposed on the top of the throttle body 20 at an upstream position of the throttle valve 21. The output signals from the potentiometer 36 and the air-flow meter 37 are fed into an electronic control device. An air-flow control valve 38 for controlling an idling speed of the engine 10 is disposed at an longitudinal end of the air cleaner case 12 (at the left side end in FIGS. 1, 2). The air-flow control valve 38 controls amount of air which by-passes the throttle valve 21 and directly flows from the clean side space 17 to the surge tank 23.

The structural features of the present embodiment which contribute to making the air-supply module small in size are as follows. First, the upstream end of the air cleaner case 12 and the downstream end of the manifold pipes 24*a*, 24*b*, 24*c* are located closely to each other so that the air passage constituted by the air cleaner case 12, the throttle body 20, the surge tank 23 and the manifold pipes 24*a*, 24*b*, 24*c* forms a loop. Secondly, the manifold pipes 24*a*, 24*b*, 24*c* curve to form a space thereabove, and the air cleaner case 12 is disposed in that space. Therefore, the air cleaner case 12 can be positioned in such a way that it is embraced within the loop, and, accordingly, a whole size of the air-supply module can be made small, especially in the vertical direction. Thirdly, the air cleaner element 14 that divides the space in the air cleaner case 12 into the dust side space 16 and the clean side space 17 is disposed in parallel to the cylinder alignment direction (the left to right direction in FIG. 1). Therefore, the dimension of the opening 12*a* of the cap 12 in the direction of the air flow "a" (FIG. 4) can be made small. In other words, the thickness of the opening 12*a* is sufficient if it can receive the thickness of the air cleaner element 14 shown in FIG. 8. The air cleaner element 14 is inserted or taken out through the opening 12*a* in the direction "E" shown in FIGS. 3 and 8. This also contributes to making the air-supply module 11 compact in size.

Now, the operation of the air-supply module 11 will be described. Outside air is sucked into the dust side space 16 of the air cleaner case 12 through the air-intake port 15 when the engine 10 is driven. The sucked air flows through the air cleaner element 14 in the direction "a" shown in FIG. 4, thereby dusts or particles contained in the air are filtered by the air cleaner element 14. The clean air enters into the clean side space 17, and flows toward the throttle body 20 through the connecting duct 19. The amount of air is controlled by the throttle valve 21, and then flows into the surge tank 23 where pulsation of air is alleviated. Then, the intake-air is distributed to each manifold pipe 24*a*, 24*b*, 24*c*. On the other hand, pressurized fuel is sent from a fuel supply pump (not shown) through the fuel delivery pipe 33 and distributed to each injector 31. A controlled amount of fuel is injected from the injector 31 into the cylinder with controlled timing, because the injector 31 is electronically controlled by an electronic controller (not shown). The intake-air and the fuel are mixed in the intake port 10*b* and sucked into the cylinder.

All the components, the air cleaner case 12, communication chamber 18, the connecting duct 19, throttle body 20, the surge tank 23 and the manifold pipes 24*a*, 24*b*, 24*c*, are made of resin, and integrated into a single unit by molding together, seizing or any other methods. The air-supply module 11 is mounted on the engine 10 as a single unit. That is, the bolts 26 fixed on the mounting surface 11*c* of the engine 10 are inserted into the mounting holes 27 formed on the flange 25, and then the nuts 28 are screwed onto the bolts 26 by the nut runner 29. No other step is required to mount the air-supply module 11 on the engine 10. As mentioned above, since the tool space "S" is provided, the nut runner 29 can directly reach the nut 28 to be screwed. Accordingly, the air-supply module 11 is easily mounted on the engine 10 without disassembling any of its components.

(Second Embodiment)

Figure 9:
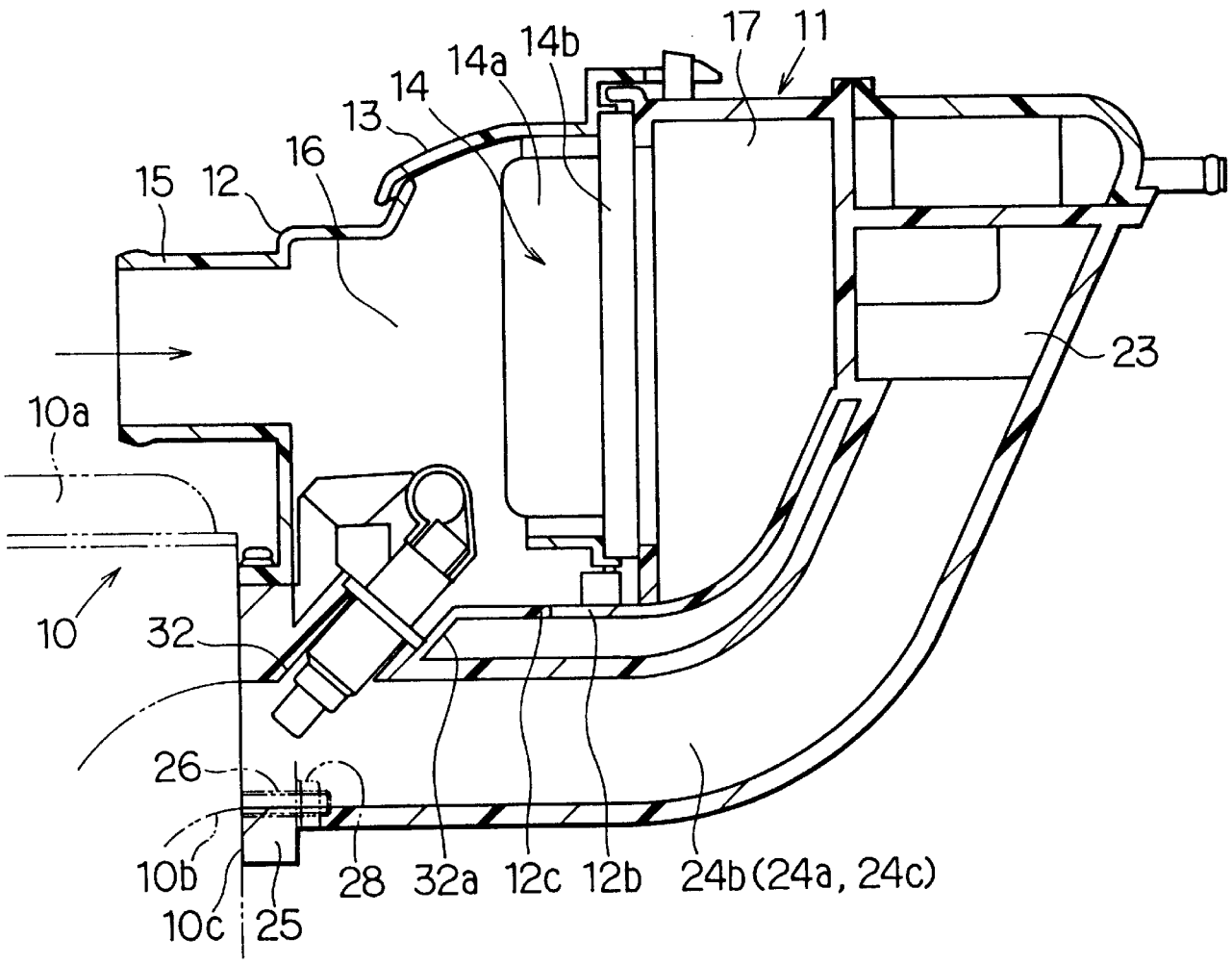
FIG. 9 is a cross-sectional view showing an air-supply module as a second embodiment of the present invention, and shows a similar sectional portion as in FIG. 4.
Figure 10:
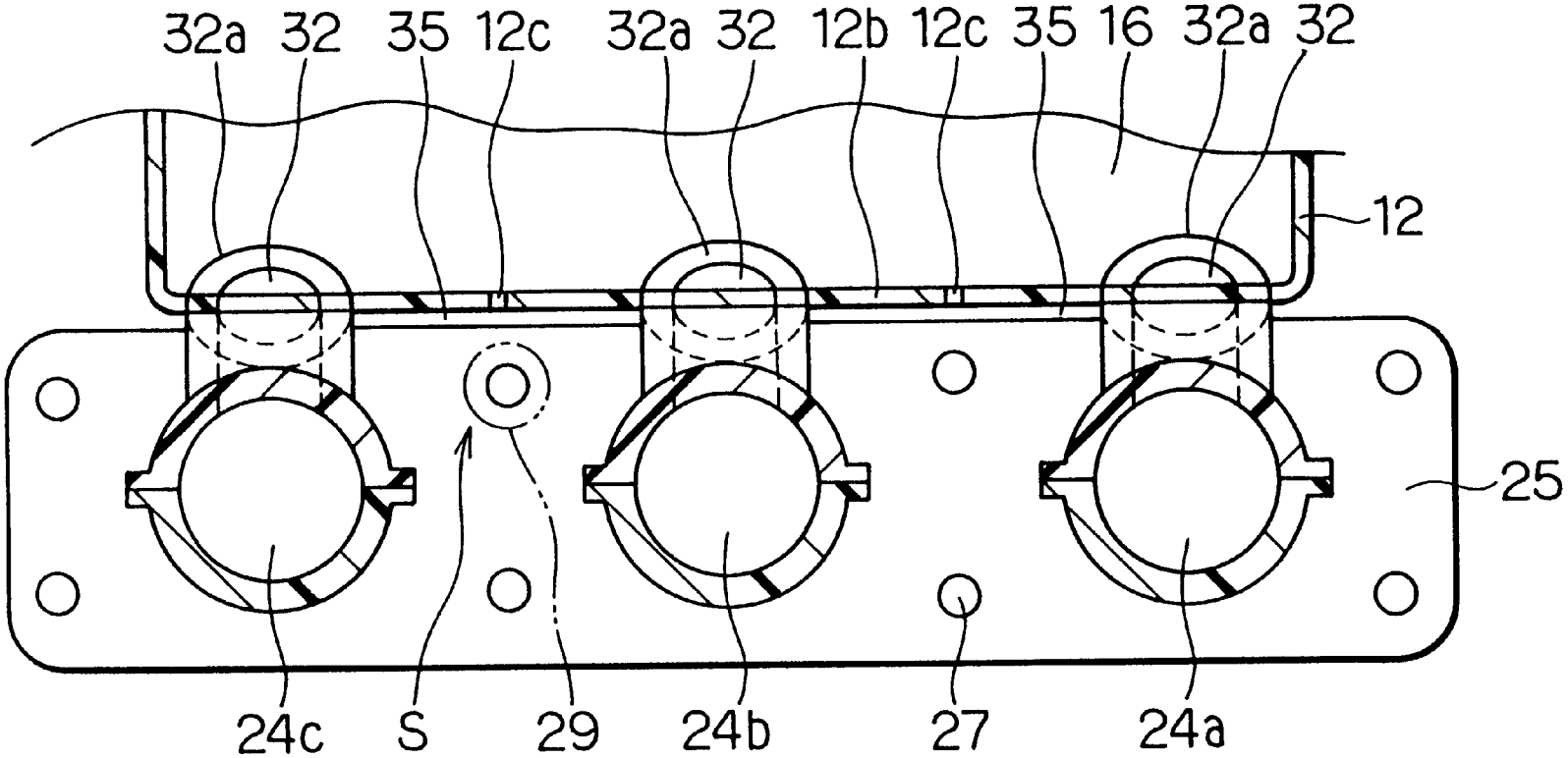
FIG. 10 is a fragmentary view showing the air-supply module shown in FIG. 9.

Referring to FIGS. 9 and 10, a second embodiment of the present invention will be described. FIG. 9 shows a cross-section which is similar to that of FIG. 4 of the first embodiment. FIG. 10 shows a fragmentary cross-section which is similar to that of FIG. 7 of the first embodiment. In the second embodiment, the bottom wall 12*b* of the air cleaner case 12 is made flat as opposed to that of the first embodiment. There is a space 35 between the bottom wall 12*b* and the upper surface of the flange 25. Three cylindrical portions 32*a*, each for forming the injector hole 32 therein, are formed on the flange 25. The cylindrical portions 32*a* connect the bottom wall 12*b* of the air cleaner case 12 and engine side end of each manifold pipe 24*a*, 24*b*, 24*c*. Also, the flange 25 and the bottom wall 12*b* are connected together at the positions where the cylindrical portions 32*a* are formed. Thus, the air cleaner case 12, the manifold pipes 24*a*, 24*b*, 24*c* and the flange 25 are all firmly connected. Other structures of the second embodiment are the same as those of the first embodiment. The second embodiment operates in the same manner as the first embodiment.

(Third Embodiment)

Figure 11:
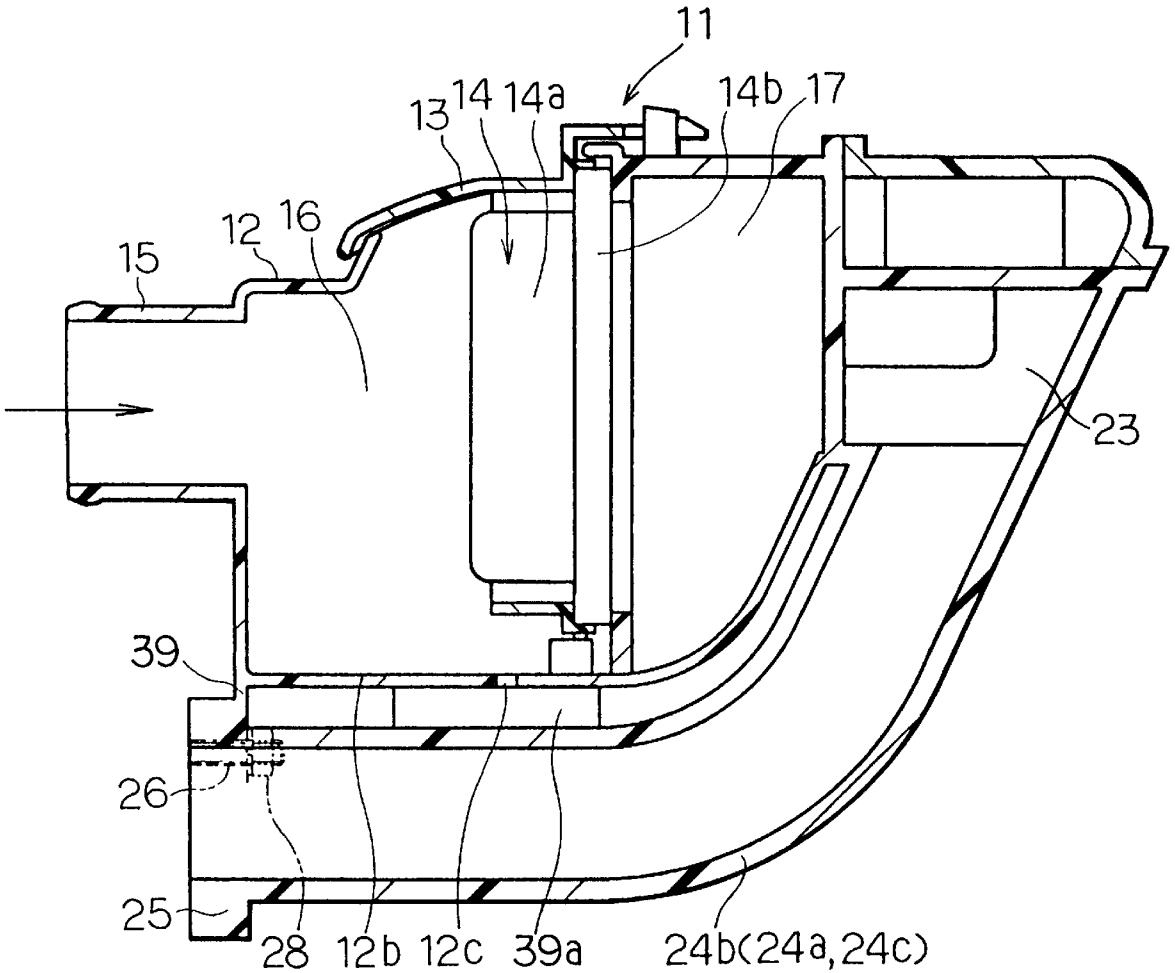
FIG. 11 is a cross-sectional view showing an air-supply module as a third embodiment of the present invention, and shows a similar sectional portion as in FIG. 4.
Figure 12:
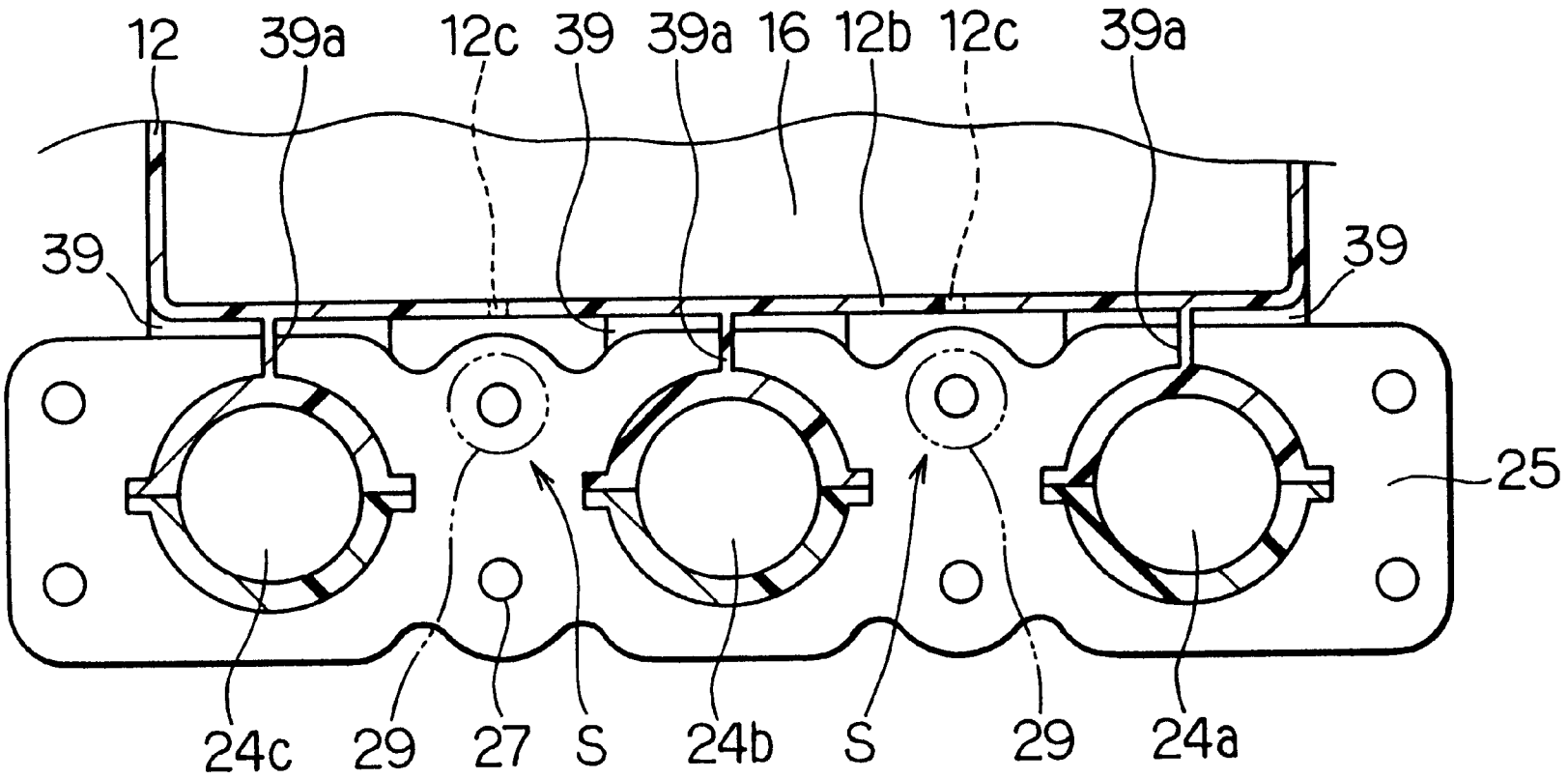
FIG. 12 is a fragmentary cross-sectional view showing the air-supply module shown in FIG. 11.

Referring to FIGS. 11 and 12, a third embodiment of the present invention will be described. FIG. 11 shows a cross-section which is similar to that of FIG. 4 of the first embodiment. FIG. 12 shows a fragmentary cross-section which is similar to that of FIG. 7 of the first embodiment. In the third embodiment, the injector holes 32 are eliminated because the fuel injectors 31 are installed directly in the intake port 10*b*. The bottom wall 12*b* of the air cleaner case 12 is connected to each manifold pipe 24*a*, 24*b*, 24*c* by connecting ribs 39*a*. The bottom wall 12*b* and the flange 25 are connected by other connecting ribs 39 that are formed at three positions as shown in FIG. 12. Other structures of the third embodiment are the same as those of the first and second embodiments. The second embodiment operates in the same manner as the first embodiment.

(Fourth Embodiment)

Figure 13:
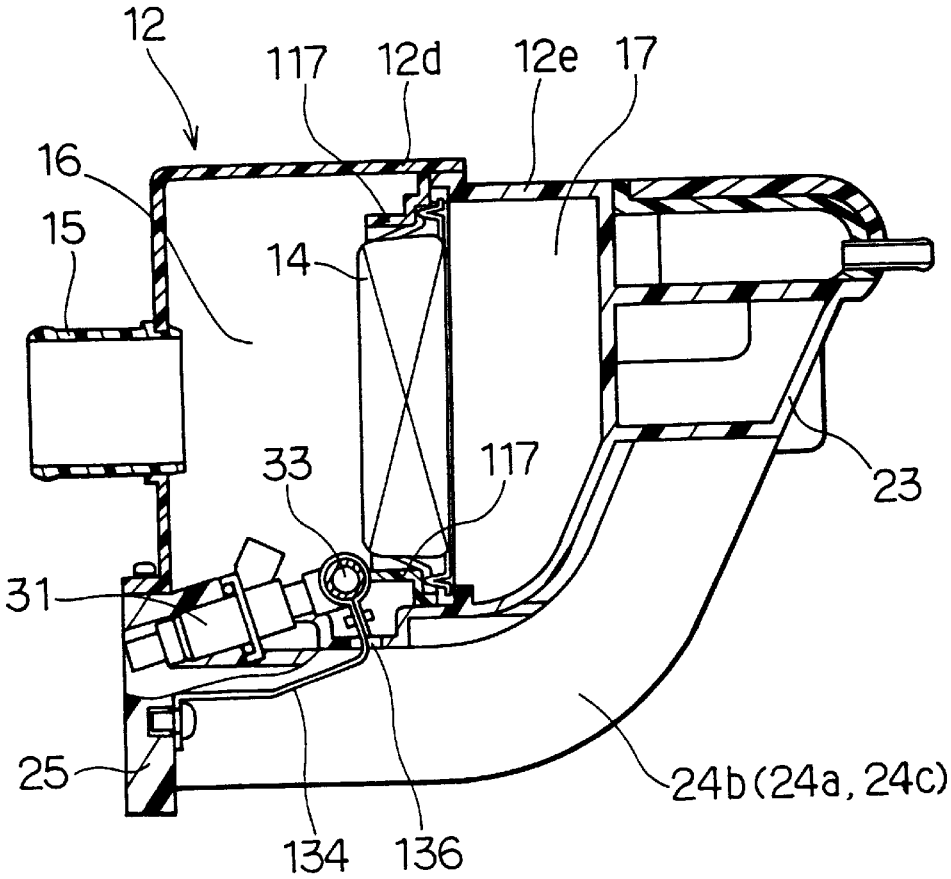
FIG. 13 is a cross-sectional view showing an air-supply module as a fourth embodiment of the present invention, and shows a similar sectional portion as in FIG. 4.
Figure 14:
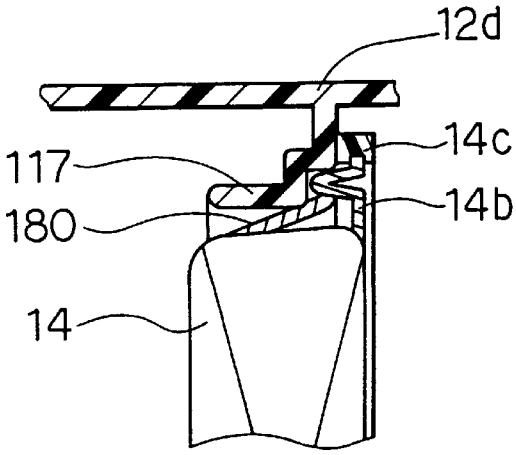
FIG. 14 is a fragmentary cross-sectional view showing a mounting structure of an air filter element used in the air-supply module shown in FIG. 13.

A fourth embodiment will be described, referring to FIGS. 13 and 14. FIG. 13 shows a similar cross-section as that shown in FIG. 4 of the first embodiment. In the fourth embodiment, the air cleaner case 12 is divided into two parts, a first case 12*d* and a second case 12*e*. The first case 12*d* forms the dust side space 16, and the second case 12*e* forms the clean side space 17. The first ca se 12*d* is removable relative to the second case 12*e*. A supporting frame 117 for supporting the air cleaner element 14 therein is formed at a position where the first case 12*d* is connected to the second case 12*e*. The air cleaner element 14 is held between the first and second cases 12*d*, 12*e* as shown in FIG. 14 in detail. A retainer 180 is interposed between the supporting frame 117 and the air cleaner element 14 for securely holding the air cleaner element 14 in the position. A gasket 14*c* is disposed to cover the outer edge 14*b* of the air cleaner element 14 to enhance air-tightness. The air cleaner element 14 is installed on the first case 12*d* before the first case 12*d* is assembled to the second case 12*e*.

The fuel delivery pipe 33 is held by a stay 134 which in turn extends to the outside of the air cleaner case 12 and fixed to the flange 25. By thus holding the injectors 31, the structure of the air cleaner case 12 is simplified, and the delivery pipe 33 and the injectors 31 are securely held at their positions.

Other structures of the fourth embodiment are the same as those of the first embodiment. The fourth embodiment operates in the same manner as the first embodiment.

(Fifth Embodiment)

Figure 15:
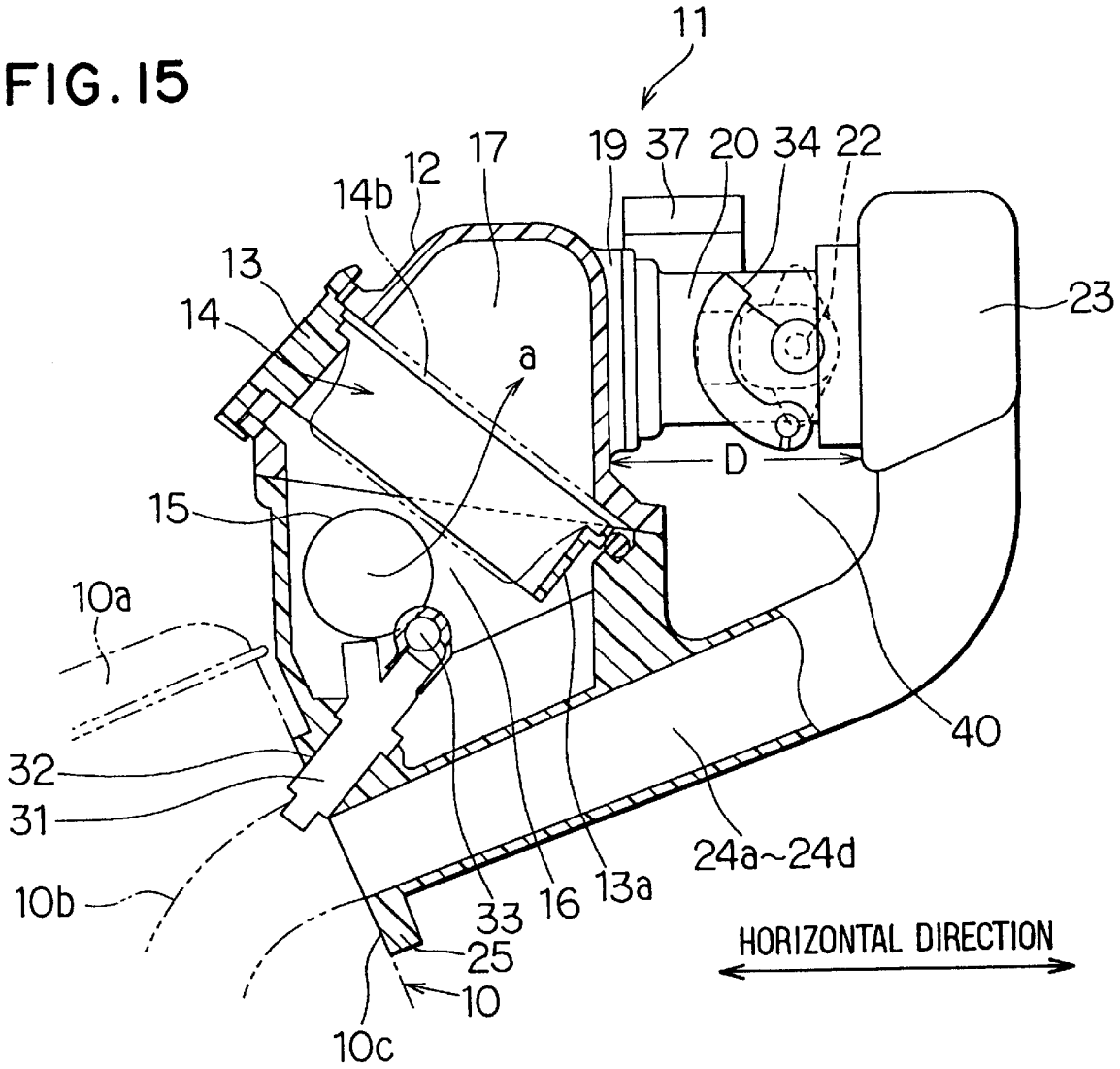
FIG. 15 is a cross-sectional view showing an air-supply module as a fifth embodiment of the present invention, and shows a similar sectional portion as in FIG. 4.
Figure 16:
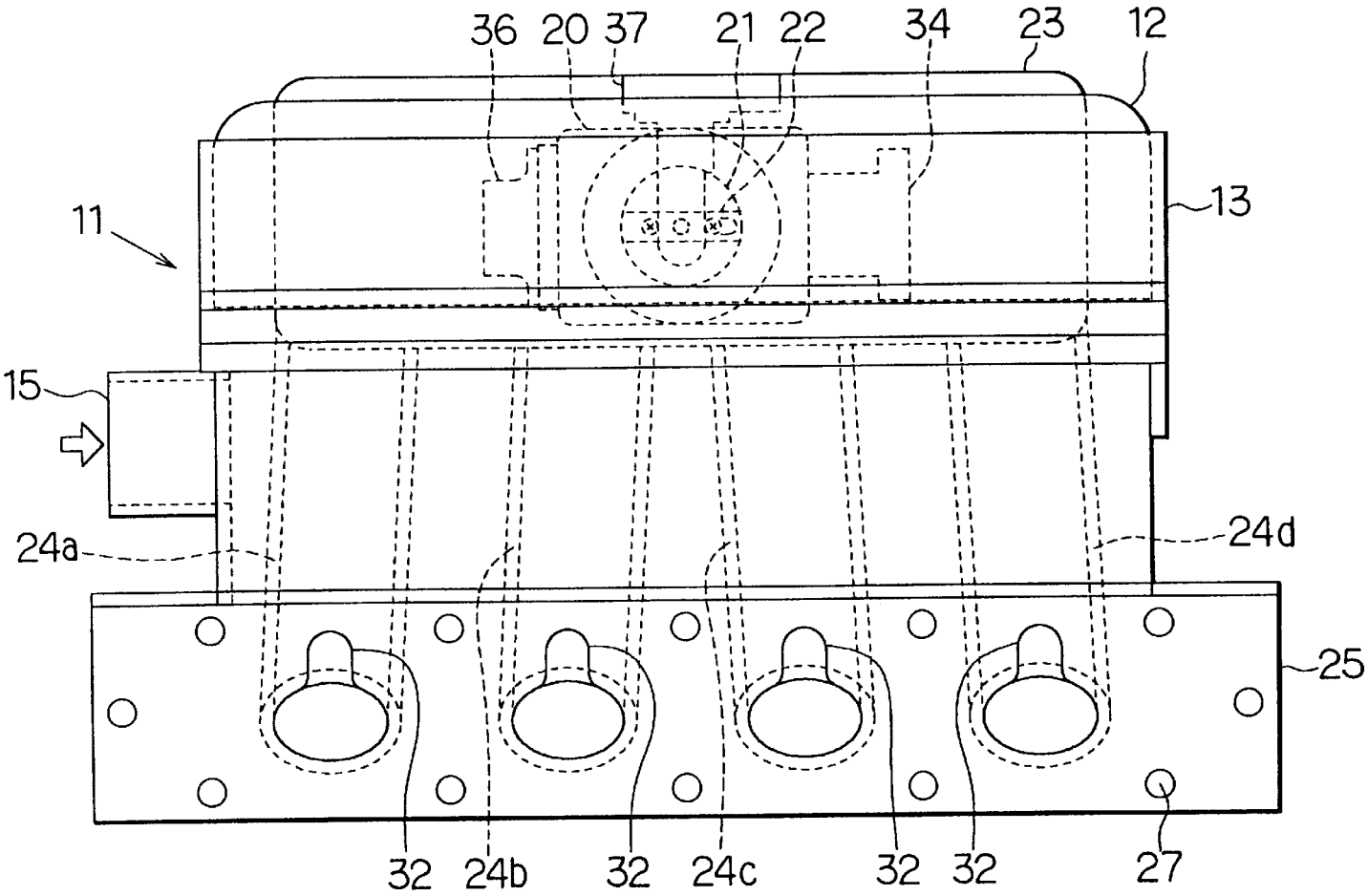
FIG. 16 is a front view of the air-supply module shown in FIG. 15.
Figure 17:
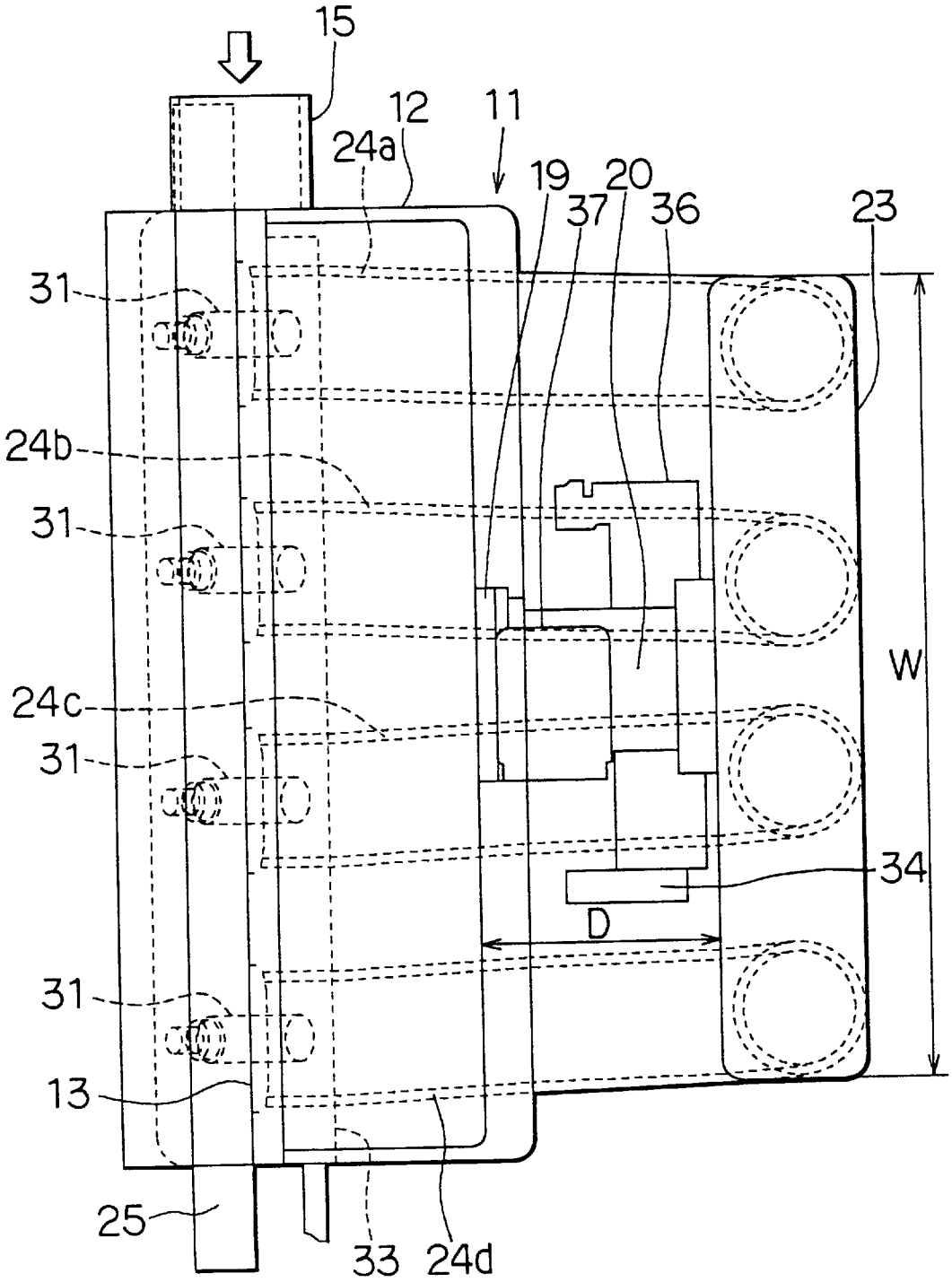
FIG. 17 is a top view of the air-supply module shown in FIG. 15.

Referring to FIGS. 15, 16 and 17, a fifth embodiment of the present invention will be described. Parts and components of the air-supply module 11 which perform the same function as those of the foregoing embodiments are labeled with the same numbers. The fifth embodiment is designed to be mounted on a four-cylinder engine, and, accordingly, four intake manifold pipes 24*a* to 24*d* and four injectors 31 are installed on the air-supply module 11.

The longitudinal direction of the air cleaner case 12 and the surge tank 23 is aligned in parallel to the engine cylinder alignment direction, and the manifold pipes 24*a* to 24*d* connecting the surge tank 23 and the intake ports 10*b* are located under the air cleaner case 12 and the surge tank 23, as shown in the drawings. The surge tank 23 has its longitudinal width W as shown in FIG. 17. As better seen in FIG. 15, the air cleaner case 12 and the surge tank 23 are aligned horizontally at a same level, and a space 40 is formed by the air cleaner case 12, the surge tank 23 and the manifold pipes 24*a* to 24*d*. In the space 40, the throttle body 20 having the throttle valve 21 is positioned. The upstream end of the throttle body 20 is connected to the air cleaner case 12 via the connecting duct 19, and the downstream end thereof is connected to the surge tank 23. The shaft 22 of the throttle valve 21 is positioned in parallel to the engine cylinder alignment direction. The drive lever 34 is disposed at one end of the shaft 22, and the potentiometer 36 is disposed at the other end (FIG. 16). Because of the space 40, the drive lever 34 and the potentiometer 36 can be easily placed at their positions. The air-flow meter 37 is located on the throttle body 20 as shown in FIG. 15.

The air cleaner element 14 is disposed in the air cleaner case 12 with an angle slanted toward the engine 10 (FIG. 15). The dust side space 16 is positioned at the lower side of the air cleaner case 12, while the clean side space 17 is positioned at the upper side. Water that may enter, especially when it rains, into the air cleaner case 12 from the air-intake port 15 can be kept in the dust side space 16. Therefore, water can be effectively prevented from entering into the clean side space 17 through the air cleaner element 14. The water retained in the dust side space 16 is drained from the drain hole 12*c* formed on the bottom wall 12*b* (FIG. 4).

(Sixth Embodiment)

Figure 18:
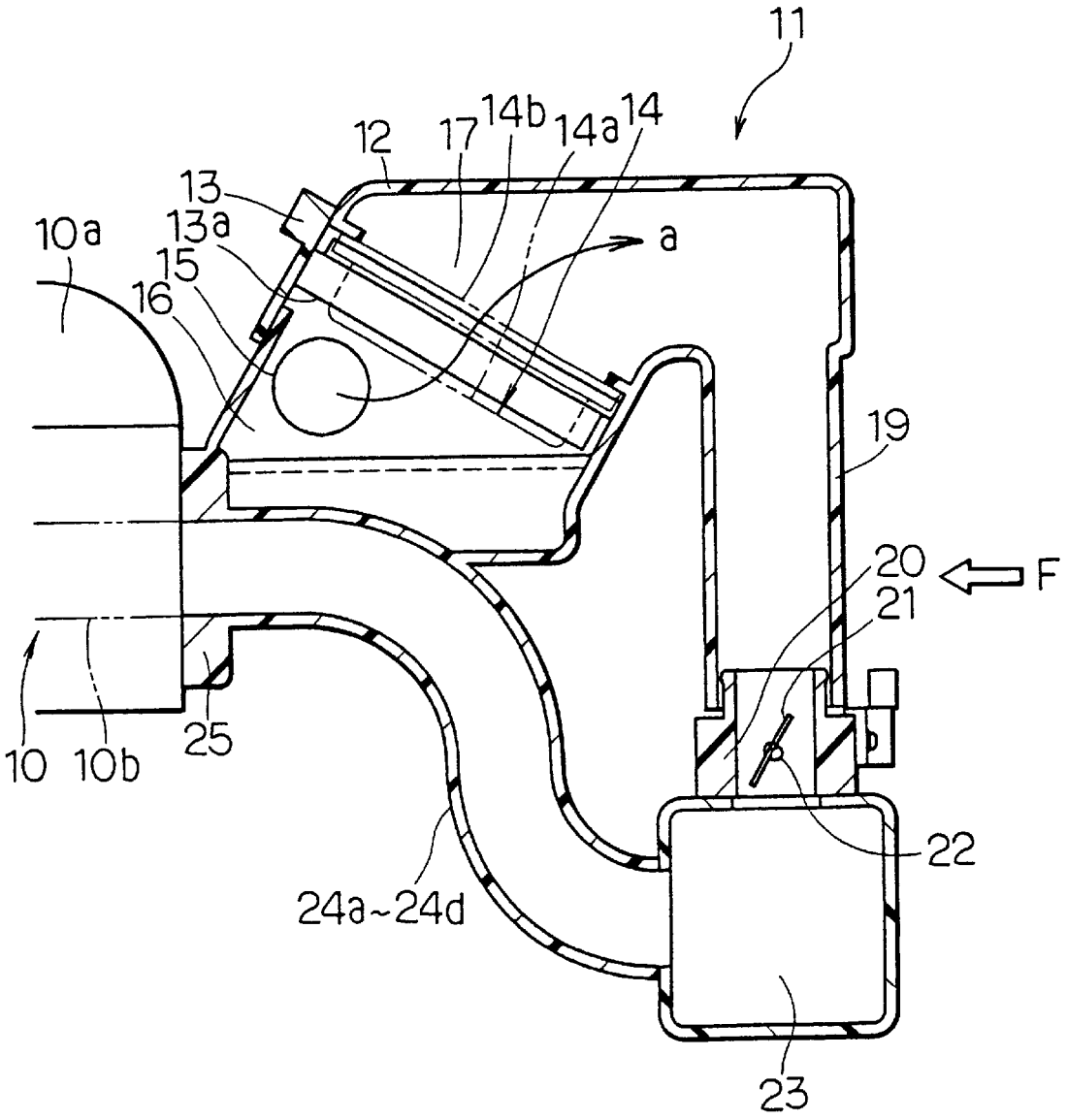
FIG. 18 is a cross-sectional view showing an air-supply module as a sixth embodiment of the present invention, and shows a similar sectional portion as in FIG. 4.
Figure 19:
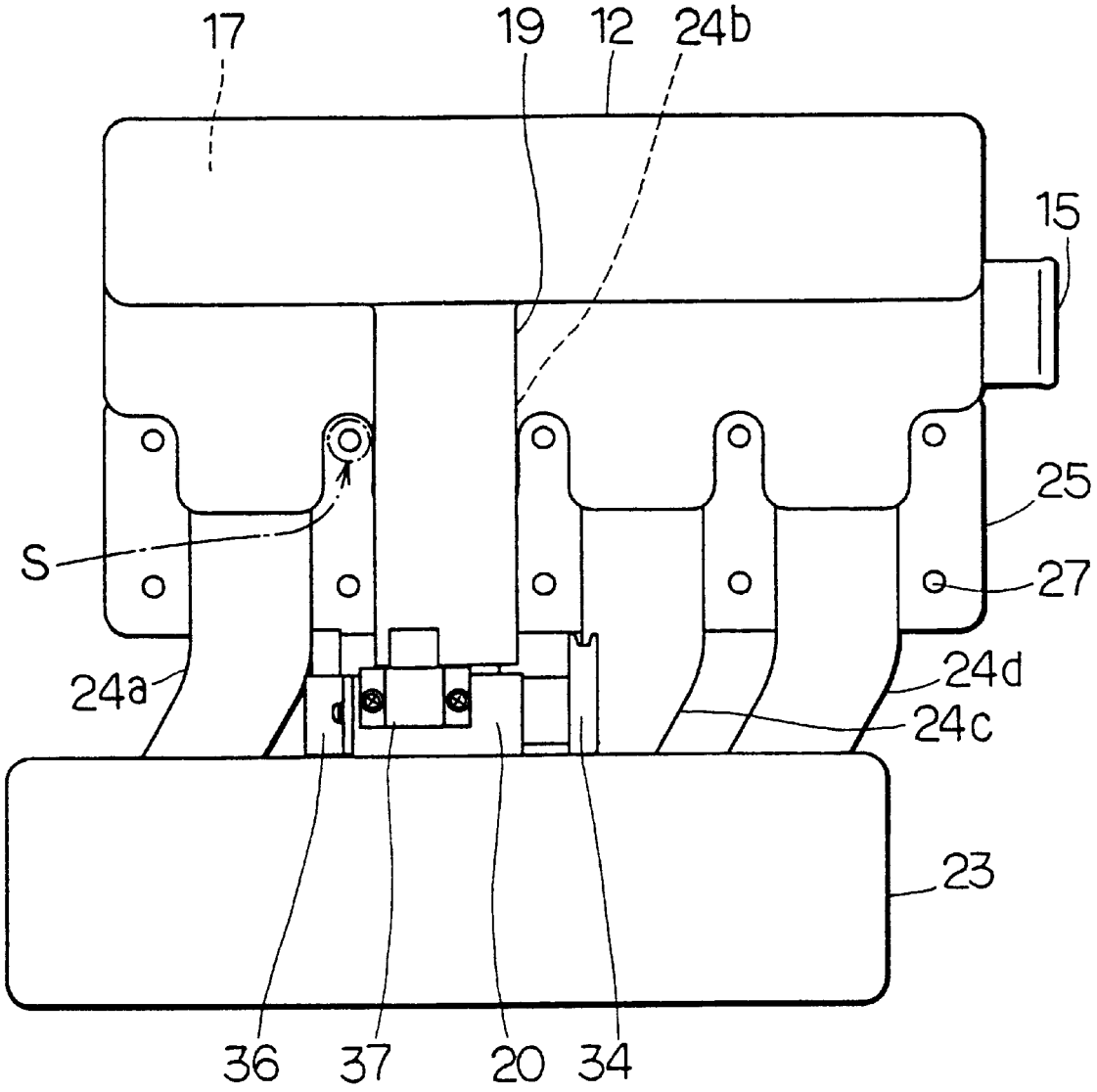
FIG. 19 is a rear view of the air-supply module shown in FIG. 18, viewed from a direction F in FIG. 18.

A six embodiment which is a modification of the fifth embodiment is shown in FIGS. 18 and 19. The connecting duct 19 is extended downward, and the throttle body 20 is connected to the connecting duct 19 at its bottom end. The surge tank 23 is connected to the throttle body 20 at its bottom end. The manifold pipes 24*a* to 24*d* each having a curved shape connect the surge tank 23 and the respective intake ports 10*b* as shown in FIG. 18. Since the injectors 31 are directly installed in the cylinder head 10*a*, no injector holes 32 are formed in the flange 25 in this embodiment. The connecting duct 19 extends downward from the air cleaner case 12 and is connected to a center portion of the surge tank 23 (FIG. 19).

The connecting duct 19 is disposed in parallel with the maniflod pipes 24*a* to 24*d*, viewed from the opposite side of the engine 10, and overlaps with one of the manifold pipes (the manifold pipe 24*b* in this particular embodiment). As seen in FIG. 19, the tool spaces "S" are secured between the manifold pipes, so that the tool can reach the nuts directly from the outside of the air-supply module 11. The surge tank 23, the longitudinal direction of which is placed in parallel to the engine cylinder alignment direction, is off-centered with respect to the center of the engine cylinder alignment by half a pitch of neighboring manifold pipes. The manifold pipes 24*a* to 24*d* are connected to the surge tank 23, being curved to compensate the off-centered distance. Other structures are the same or similar to those of the fifth embodiment.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An air-supply module for an internal combustion engine having intake ports aligned to define an engine cylinder alignment direction and having an air intake direction perpendicular to said engine cylinder alignment direction, the air supply module comprising:

an air-intake passage defining an air flow path extending in a direction generally perpendicular to said engine cylinder alignment direction;

a surge tank connected to the air-intake passage for alleviating pulsation of air sucked thereinto;

a plurality of manifold pipes connecting the surge tank and the intake ports of the engine, the manifold pipes being oriented generally in planes that are generally perpendicular to said engine cylinder alignment direction; and a flange to which the manifold pipes are connect at their intake port side, the flange including means for mounting the air-supply module on the engine, wherein:

the air-intake passage, the surge tank, the plurality of manifold pipes and the flange are all integrated into a single unit to form the air-supply module which can be mounted on the engine as said single unit by the mounting means; and a tool space is provided which permits a tool for mounting the air-supply module on the engine to reach the mounting means directly from an outside of the air-supply module, whereby the air-supply module is adapted to bc mounted on the engine as said single unit.

2. The air-supply module for an internal combustion engine as in claim 1, wherein:

the air-intake passage and the manifold pipes are mechanically connected by connecting members which also mechanically connected to the flange; and the connecting members define a part of the tool space.

3. The air-supply module for an internal combustion engine as in claim 2, wherein:

the connecting members are formed for each manifold pipe and extend along the manifold pipe.

4. The air-supply module for an internal combustion engine as in claim 1, wherein:

injector holes for inserting injectors therein are formed on the flange, each injector hole corresponding to each manifold pipe.

5. The air-supply module for an internal combustion engine as in claim 1, wherein:

the air-intake passage comprises an air cleaner case containing an air cleaner element therein.

6. The air-supply module for an internal combustion engine as in claim 5, wherein said tool space is defined between adjacent manifold pipes and adjacent a bottom wall of said air cleaner case.

7. The air-supply module for an internal combustion engine as in claim 5, wherein:

the air cleaner case is placed at a position close to the engine and the surge tank is placed at a position remote from the engine; and the manifold pipes are connected to a bottom of the surge tank and extend toward the engine.

8. The air-supply module for an internal combustion engine as in claim 1, further including a connecting duct that connects the air-intake passage and the surge tank, wherein:

a longitudinal direction of the surge tank is in parallel to a direction of engine cylinder alignment; and the connecting duct extends in parallel to the manifold pipes and overlaps with one of the manifold pipes.

9. The air-supply module for an internal combustion engine as in claim 8, wherein:

the connecting duct is connected to the surge tank at a longitudinal center of the surge tank.

10. The air-supply module for an internal combustion engine as in claim 9, wherein:

the number of manifold pipes is an even number.

11. The air-supply module for an internal combustion engine as in claim 9, wherein:

the longitudinal center of the surge tank is off-centered with respect to a center of the engine cylinder alignment by a off-center distance; and each manifold pipe is connected to each intake port, curving toward the engine by the off-center distance.

12. The air-supply module for an internal combustion engine as in claim 1, wherein:

the air-intake passage comprises an air filter case containing an air filter element therein; and the air cleaner element is slidably inserted and removed from the air cleaner case in a direction perpendicular to a thickness direction of the air cleaner element.

13. The air-supply module for an internal combustion engine as in claim 12, wherein:

the air intake passage further comprises a throttle body including a throttle valve that controls amount of air sent from the air cleaner case to the surge tank;

the air cleaner case and the surge tank are horizontally aligned making a space therebetween; and the throttle body is disposed in the space between the air cleaner element and the surge tank.

14. The air-supply module for an internal combustion engine as in claim 13, wherein:

a shaft for driving the throttle valve is disposed in parallel to a longitudinal direction of the surge tank.

15. The air-supply module for an internal combustion engine as in claim 14, wherein:

a drive lever for driving the shaft is fixed to one end of the shaft and a potentiometer for detecting an opening degree of the throttle valve is disposed at the other end of the shaft.

16. The air-supply module for an internal combustion engine as in claim 13, wherein:

the air cleaner case is placed at a position close to the engine and the surge tank is placed at a position remote from the engine; and the manifold pipes are connected to a bottom of the surge tank and extend toward the engine.

17. The air-supply module for an internal combustion engine as in claim 12, wherein:

a space in the air cleaner case is divided by the air cleaner element into a dust side space to which outside air is introduced and a clean side space to which air filtered by the air cleaner element is introduced.

18. The air-supply module for an internal combustion engine as in claim 17, wherein:

the air cleaner element is disposed in the air cleaner case with an angle slanted toward the engine so that the dust side space is positioned downward and the clean side space is positioned upward.

19. The air-supply module for an internal combustion engine as in claim 1, wherein said air flow path of said an air-intake passage extends in a direction generally parallel to said air intake direction of said intake ports.

20. The air-supply module for an internal combustion engine as in claim 1, wherein the number of manifold pipes is an odd number.

21. The air-supply module for an internal combustion engine as in claim 1, wherein:

the air-intake passage comprises an air filter case containing an air filter element therein; and the air-intake passage further comprises a throttle body including a throttle valve for controlling an amount of air sent from the air filter case to the surge tank.

22. The air-supply module for an internal combustion engine as in claim 21, wherein a shaft for driving the throttle valve is disposed in parallel to a longitudinal direction of the surge tank.

23. The air-supply module for an internal combustion engine as in claim 21, wherein the air-intake passage further comprises a connecting duct communicating the air filter case and the throttle body.

24. The air-supply module for an internal combustion engine as in claim 23, wherein the connecting duct is connected to the surge tank at a longitudinal end of the surge tank.

25. The air-supply module for an internal combustion engine as in claim 1, wherein a longitudinal direction of the surge tank is in parallel to the direction of engine cylinder alignment.

26. The air-supply module for an internal combustion engine having intake ports, the air supply module comprising:

an air-intake passage;

a surge tank connected to the air-intake passage for alleviating pulsation of air sucked thereinto;

a plurality of manifold pipes connecting the surge tank and the intake port of the engine; and a flange to which manifold pipes are connect at their intake port side, the flange including means for mounting the air-supply module on the engine, wherein:

the air-intake passage, the surge tank, the plurality of manifold pipes and the flange are all integrated into a single unit to form the air-supply module which can be mounted on the engine as a whole by the mounting means;

a tool space is provided which permits a tool for mounting the air-supply module on the engine to reach the mounting means directly from an outside of the air-supply module; wherein:

the air-intake passage comprises an air filter case containing an air filter element therein;

the air cleaner element is slidably inserted and removed from the air cleaner case in a direction perpendicular to a thickness direction of the air cleaner element; and the manifold pipes are disposed with a curve to thereby define an inside space and the air cleaner case is disposed in the inside space.

27. The air-supply module for an internal combustion engine as in claim 26, wherein:

when the module is mounted on the engine, the inside space is defined vertically above the manifold pipes and the air cleaner case is disposed vertically above the manifold pipes; and an opening for inserting and removing the air filter element is formed on a top surface of the air cleaner case.

28. The air-supply module for an internal combustion engine as in claim 27, wherein:

a longitudinal direction of the air cleaner element is placed in parallel to a direction of engine cylinder alignment.

* * * * *